United States Patent [19]

Wilder, deceased

[11] 4,131,818

[45] Dec. 26, 1978

[54] NIGHT VISION SYSTEM

[75] Inventor: Marshall Wilder, deceased, late of Portola Valley, Calif., by Virginia H. Wilder, executrix

[73] Assignee: Varian Associates, Inc., Palo Alto, Calif.

[21] Appl. No.: 675,279

[22] Filed: Oct. 12, 1967

[51] Int. Cl.[2] ..... H01J 39/14

[52] U.S. Cl. ..... 313/95

[58] Field of Search ..... 313/94, 95, 96, 103, 313/104, 108, 67, 103 R, 103 CM; 315/11; 250/207, 213 VT

[56] References Cited

U.S. PATENT DOCUMENTS

| | | | |
|---|---|---|---|
| 2,158,853 | 10/1937 | Coolidge | 313/95 |
| 3,039,017 | 6/1962 | Brown et al. | 313/95 X |
| 3,244,921 | 4/1966 | Behun | 313/94 |
| 3,327,151 | 6/1967 | Adams et al. | 313/104 X |

*Primary Examiner*—Theodore M. Blum
*Attorney, Agent, or Firm*—Stanley Z. Cole; Edward J. Radlo; Warren M. Becker

[57] ABSTRACT

Image detection and intensification under exceedingly low levels of illumination, as of $10^{-2}$ to $10^{-5}$ foot candles, is made possible by combining the advantages of conventional inverter image tubes with those of recently developed microchannel plate wafer tubes. Under environmental conditions necessitating an overall luminous gain of 50,000, a microchannel plate wafer tube is coupled to the output of a conventional inverter image tube permitting cone viewing by operating personnel. This is made possible by operating the microchannel plate wafer tube at low electron gain levels such that microchannel plate noise characteristics are maintained at acceptable levels. The objectives of reduced size, weight, and power consumption approximating that of a single stage of the presently used three stage night vision systems are thereby achieved. Furthermore, since external photocathode processing techniques may be used in the manufacture of the microchannel plate wafer tubes and modular construction is permitted, greater production yields are realized at significant cost savings.

3 Claims, 3 Drawing Figures

INVENTOR.
MARSHALL P. WILDER
BY
ATTORNEY

NIGHT VISION SYSTEM

BACKGROUND OF THE INVENTION

The present invention relates in general to night vision systems, or so-called starlight scopes, but, more specifically, to a novel apparatus essentially comprising an inverter image tube coupled at its output to a microchannel plate wafer tube for image intensification which combination permits modular construction and economical external photocathode processing techniques without seriously impairing the degree of information extraction.

Typical levels of illumination for which such systems are designed are exceedingly low, as of $10^{-2}$ to $10^{-5}$ foot candles, depending on the moon, cloud cover, etc. As a consequence, the visual gain of such devices must be high since the human eye should be put in the position to utilize cone rather than rod viewing for reason of the higher acuity associated with the former. Further, the quantum efficiency of the first sensing element should be as high as possible so as to optimize the degree of information extraction and minimize the deteriorating effects of quantum fluctuation noise, that is, noise which results from the physical phenomena of unequal numbers of photons being emitted from an emitting body during successive equal time intervals. Additionally, the resolution (or high spatial frequency cut-off point of the modulation transfer function) in terms of line pairs per millimeter (Lp/mm) should be adequate to permit target recognition at the desired range and field of view of the instrument and, lastly, the weight, size and power requirements of the system should be small so as to assure portability.

To meet these prerequisites and the necessary objectives of usefulness and reliability under the above-described condition of low level illumination, any proposed system should have an overall luminous gain of 50,000 (2870°K light in, P-20 phosphor light out) with a resolution of around 30 Lp/mm. The peak quantum efficiency of the first energy converter, typically an S-20 photocathode, may be around 15 to 20%.

Such performance requires, at the present time, three cascaded single-stage visible light inverter image tubes, the input of each stage of which is comprised of a fiber optic component serving as substrate of an S-20 photocathode and the output of which is comprised of a fiber optical component overlaid with P-20 phosphors.

The three stage assemblies perform reasonably well; however, they are far too large, too heavy and too costly. As a result, their general use has been limited to use on hand-carried instruments and then by only a limited number of persons who need and would otherwise use them.

Various proposals have been submitted for reducing the size and weight of night vision systems for application to, such as, for example, individual goggles.

Of the proposals, two look most promising and utilize the recently developed microchannel plates and microchannel plate wafer tubes. In one, a microchannel plate inverter tube, a microchannel plate is inserted in proximity focus within the vacuum envelope of a conventional inverter image tube between the electron focusing electrodes and the phosphor output screen. In another, a microchannel plate wafer tube is coupled at its output to a fiber optic image inverter, called a twister.

Due to device noise believed to be due to geometric and electrical imperfections between channels as well as groups of channels and a high residual gas content in the microchannel plate, high mode performance of the proposed devices necessary for a visual gain of 50,000 has been disappointing.

While the first of the proposals, namely, image inversion by an electron optical system is preferred over the use of a twister to reduce optical losses and distortions, use of the former does lead to complications by virtue of the resulting parabaloidally shaped image plane. Thus, microchannel plate inverter tubes have been found to suffer from an effective radial increase in channel length-to-diameter ratio as the parabaloidally curved electron optical image plane matched to a flat microchannel plate entrance plane yields paraxial first impact points shifted along the channel axis toward the channel exit. The net effect is a paraxially lower microchannel plate electron multiplication gain.

SUMMARY OF THE INVENTION

The present invention avoids altogether the paraxially lower brightness in the prior known microchannel plate inverter tubes and utilizes in its stead a microchannel plate wafer tube at electron gain values at which device noise characteristics are acceptable without a substantial increase in system size, weight and power consumption.

As described herein, an image is projected on the entrance window of a conventional inverter image tube by means of light optics which may be refractive, reflective or catadioptic. The entrance window is a plano-concave fiber optic component which carries on its concave or vacuum side a highly sensitive S-20 photocathode processed internally in a conventional manner. An axially symmetric electron optical system accelerates and focuses the photoelectrons emitted from the S-20 photo surface onto an aluminized P-20 phosphor screen which is deposited onto the concave side of a plano-concave high resolution fiber optic component forming the output window. Such tubes, operating in a mono-voltage mode are known to have a luminous gain of approximately 50 to 100 and a resolution of at least 70 Lp/mm.

The second component, coupled to the output window of the image tube, consists of a microchannel plate wafer tube with the MCP operated in a low gain mode of, say, 100. Such a tube essentially comprises a microchannel plate sandwiched between a flat S-20 photocathode at its input and a flat P-20 phosphor screen at its output. More specifically, the photocathode substrate comprises a high resolution plano parallel fiber optic component upon which the S-20 photocathode is laid by external processing and subsequent photocathode transfer. Since the wafer tube is used as the second stage, the reduced quantum efficiency which may result from external photocathode processing is not critical and high production yield with proportionate cost savings is realized.

Microchannel wafer tubes of the type to be described are known to have a resolution of 30 to 35 Lp/mm. If an overall luminous gain of 50,000 is postulated, and if the inverter image tube shows a luminous gain of 50, the microchannel plate wafer tube must attain a gain of 1000. Assuming the photocathode of the microchannel plate wafer tube has a reduced luminous sensitivity of 100 $\mu$ a/L, the applicable matching integrals indicate that the effective sensitivity of such an S-20 photocathode to the spectral emissivity of the P-20 phosphor of the output screen of the inverter image tube will be approximately 60 $\mu a/L$. Assuming a kinetic energy of the electrons bombarding a P-20 phosphor screen in the microchannel plate wafer tube of 7000 volts and a dead voltage of 3000 volts, the effective gain G of a microchannel plate wafer tube can be approximated by the following equation:

$$G = 60 \times 10^{-6} \times M \times \eta \times (V_A - V_D) \times m$$

wherein

M is linear magnification $\eta$ is phosphor efficiency in lumen per watt $V_A$ is anode voltage in volts $V_D$ is phosphor screen dead voltage in volts $m$ is microchannel plate electron gain in electrons out per electrons in where $G = 1000$, $M = 1$, $\eta \approx 50$ L/w, $V_A = 7000$V, $V_D = 3000$V, and one solves for electron gain, $m$, it is seen that $m \approx 100$. In contrast, if a single microchannel plate wafer tube were required to yield a luminous gain (G) of 50,000 and assuming a typically high photocathode sensitivity of 150 $\mu a/L$, solving again for $m$, one would realize that $m \approx 2000$. This means that the omission of the inverter image tube requires the microchannel plate to perform 20 times better as far as electron gain is concerned.

Accordingly, a primary object of the invention is a night vision system which is of reduced size, weight and power consumption.

Another object of the invention is a night vision system which utilizes microchannel plate wafer tubes in a low electron gain mode.

Another object of the invention is a night vision system which, strictly modular, results in interchangeability of component parts and reduced costs.

Another object of the invention as above described is a system which permits utilization of external photocathode processing without impairing the degree of information extraction.

Other objects and features of the invention will become apparent in the detailed description when considered in connection with the accompanying drawings in which:

FIG. 1 is a block diagram of a night vision system embodying the present invention, FIG. 2 is a diagrammatic view of an inverter image tube shown in FIG. 1, and FIG. 3 is an enlarged fragmentary sectional view of a microchannel plate wafer tube shown in FIG. 1.

DETAILED DESCRIPTION

Figure 1:
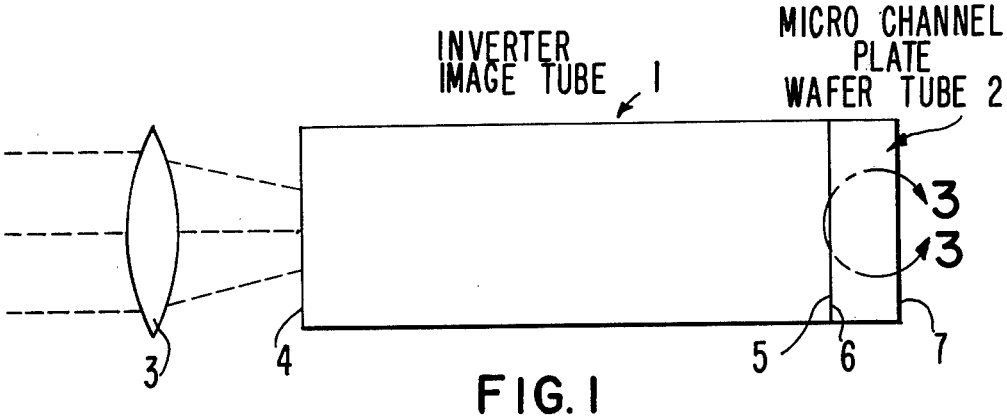

Referring to FIG. 1, there is shown a block diagram of the present invention in which an inverter image tube 1 is coupled to a microchannel plate wafer tube 2. An image to be detected and recognized is projected by means of light optics, represented by a lens 3, which may be reflective, refractive or catadioptic, upon an entrance window 4 of the inverter image tube 1. The output window 5 of image tube 1 is random coupled, as of by coupling oil or lens cement, to the entrance window 6 of the microchannel plate wafer tube 2. The output window 7 of the wafer tube 2 is exposed for viewing by an operator who is put preferably in the position of using cone rather than rod viewing in order to take advantage of the higher acuity of the former. The relative size of the described two stage night vision system is but little larger than a single stage of the conventional three stage image tube systems with a proportionate reduction in weight, power consumption and little, if any, loss of efficiency in terms of gain and resolution.

Figure 2:
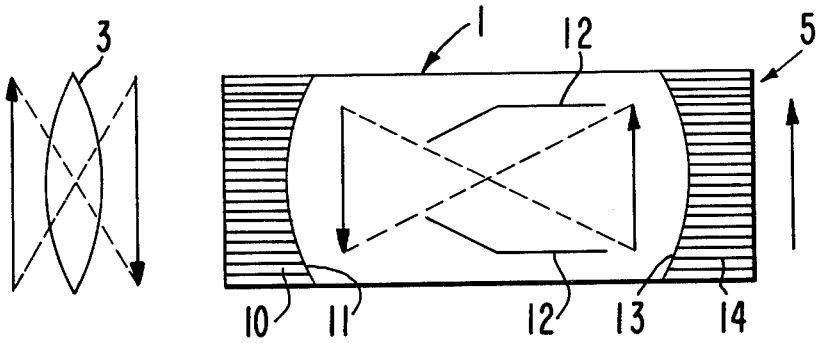

Referring to FIG. 2, there is shown an enlarged diagrammatic view of the inverter image tube of FIG. 1. The image to be recognized is projected in inverted fashion by lens 3 upon a plano-concave fiber optic component 10 which may have a fiber center-to-center spacing of, say, 5–7 microns and carries on its concave or vacuum side a highly sensitive S-20 photocathode 11 which typically is processed internally in a conventional manner. An axially symmetric electron optical system comprising a plurality of electrodes 12 accelerates and focuses the photo-electrons emitted from the S-20 photocathode 11 onto an aluminized P-20 phosphor screen 13 which is deposited on the concave side of a plano-concave high resolution fiber optic component 14 forming the output window of the image inverter. Such tubes, operating in the mono-voltage condition (focusing electrodes internally connected to the photocathode) are known to have a luminous gain (2870° K light in, P-20 phosphor light out) of approximately 50 to 100 and a resolution of at least 70 Lp/mm.

Figure 3:
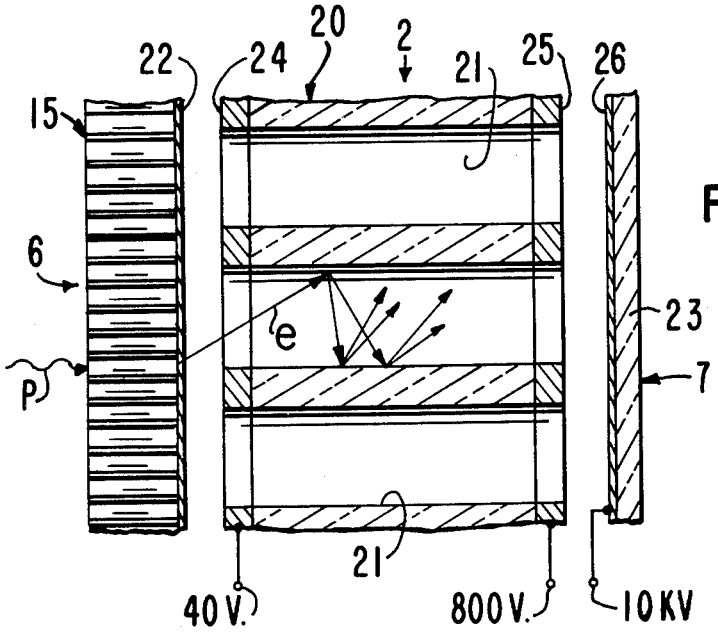

Referring now to FIG. 3, there is shown the microchannel plate wafer tube 2 which comprises in part the input window 6 which is coupled to the output window 5 of the inverter image tube 1 as described above. The wafer tube 2 further includes a microchannel plate 20 comprised, for example, of a block of dielectric material in which there is etched an array of closely spaced channels 21, such as glass, of, say, 12 micron channel center-to-center spacing and a channel length-to-diameter ratio of 60 mounted in close proximity to a flat photocathode substrate 22 which forms a portion of the input window 6 and to a flat phosphor screen substrate 23 which forms a portion of the output window 7. The photocathode substrate 22 comprises a high resolution plano parallel fiber optic component which is random coupled to the fiber optic window 5 of the image inverter tube 1 as of by coupling oil or lens cement. The phosphor screen substrate 23 is comprised of a solid unitary optically transparent medium, as of glass, onto which is deposited an aluminized P-20 phosphor screen 26. An apertured electrode 24 formed, for example, by the evaporation of conductive material is deposited at the entrance to tubes 21 and a similar apertured electrode 25 is deposited at the exit of tubes 21. In operation, a potential difference is maintained between electrodes 24, 25 as well as between electrode 25 and phosphor screen 26 for providing for electron multiplication and acceleration, respectively.

As described, the microchannel wafer tube 2 is separately constructed and distinct from the inverter image tube 1 and presently necessitates external photocathode processing due to the close proximity of photocathode and microchannel plate inhibiting the constituents of the photocathode from reaching the substrate, when internal processing is applied.

The present state of the art of photocathode transfer techniques suggests that during life high quantum efficiency photocathodes are achieved with higher probability by internal processing, while the overall tube yield in production can be expected to be substantially higher if external processing is utilized. The microchannel plate wafer tube, however, is utilized as the second stage. Fortunately, in this position the quantum efficiency of its photocathode is not critical as far as fluctuation noise performance is concerned. Consequently, state of the art photocathode transfer processes may be taken advantage of without subjecting the microchannel plate wafer tube 2 or the photocathode transfer processes to stringent photocathode efficiency requirements which would be otherwise necessary. Accordingly, the production yield of the microchannel plate wafer tube 2 can be expected to be high with resulting cost savings.

In operation, electrode 24 is maintained at a relatively low positive potential, as of 40 volts. A positive potential of 800 volts is applied to electrode 25 and a positive potential of 10K volts is applied to phosphor screen 26. It should be understood that these potentials are merely typical for low electron gain conditions. At these potentials, the overall electron gain of the microchannel wafer tube is, as prescribed, limited to acceptable levels of noise.

In terms of overall operation, an image is projected on the input window 4 of inverter image tube 1, causing the image in the form of photoelectrons emitted from the S-20 photocathode 11. The image in the form of electrons is then accelerated and focused onto the P-20 phosphor screen 13 of the inverter image tube 1. The photons emitted from the P-20 phosphor screen 13, forming the image, then are conducted by means of fiber optics 14 and 15 to the S-20 photocathode 22 of the microchannel wafer tube 2. Electrons emitted by the S-20 photocathode 22 of the microchannel plate wafer tube 2 impinge on the tube wall near the entrance point of tubes 21, whereupon they are accelerated by the field between electrodes 24, 25 colliding with the walls and giving rise to secondary electrons which are also accelerated and collide with the walls as they progress toward the exit, giving rise to additional secondary electrons.

The image in the form of a cloud of secondary electrons exit the microchannel plate 2 and impact on the P-20 phosphor screen 26 for further intensifying and producing a bright and clear picture of the projected image. It will be recalled that in prior known microchannel plate inverter tubes the electrons form a paraxial distortion at the entrance of the tubes due to the paraboloidally curved electron optical image plane. Such is not the case in the present invention since the fiber optic interface comprised of fiber optics 14 and 15 present a flat image to the entrance plane of tubes 21.

It is obvious that various change and modifications in structure and applied potentials can be made within the scope of the invention. Accordingly, the description and accompanying drawings herein are to be considered as illustrative only and not as limiting the invention as hereinafter defined.

What is claimed is:

1. A night vision system for image intensification having high luminous gain and high resolution with low noise deterioration comprising:

an inverter image tube having an input window, means coupled to said input window for converting light photons to free electrons, means for accelerating and focusing said electrons, means for converting said accelerated electrons into a new set of light photons, and an output window;

an electron multiplying image tube having an input window and an output window;

means coupling said input window of said electron multiplying image tube to said output window of said inverter image tube; and optical means focusing an inverted image of available light onto said input window of said inverter image tube.

2. A night vision system according to claim 1 wherein said electron multiplying image tube comprises:

an input window coated with a photo-electron emitting material, an output window coated with a photo emitting material, and means for producing secondary electrons disposed between said input and said output window of said electron multiplying image tube, said image being maintained in the form of an electron cloud of secondary electrons.

3. A night vision system according to claim 2 wherein said secondary electron producing means comprises:

an array of tubes having an input and an output, a first electrode disposed adjacent said input, a second electrode disposed adjacent said output, and means for applying a potential difference between said first and said second electrode.

* * * * *